United States Patent [19]

Rosman

[11] Patent Number: 4,631,918

[45] Date of Patent: Dec. 30, 1986

[54] OIL-WELL PUMPING SYSTEM OR THE LIKE

[75] Inventor: Alan H. Rosman, Woodland Hills, Calif.

[73] Assignee: Dynamic Hydraulic Systems, Inc., Canoga Park, Calif.

[21] Appl. No.: 684,860

[22] Filed: Dec. 21, 1984

[51] Int. Cl.[4] ..... F16H 39/46

[52] U.S. Cl. ..... 60/372; 60/377; 60/382; 60/414; 60/415; 60/416

[58] Field of Search ..... 60/372, 376, 377, 381, 60/382, 413, 414, 415, 416; 417/342

[56] References Cited

U.S. PATENT DOCUMENTS

| | | | |
|---|---|---|---|
| 2,811,838 | 11/1957 | Lindsey | 60/381 X |
| 2,982,100 | 5/1961 | Sinclair | 60/372 |
| 3,212,406 | 10/1965 | McDuffie | 91/165 |
| 3,939,656 | 2/1976 | Goldfein | 60/381 |
| 4,188,787 | 2/1980 | Bromell et al. | 417/217 X |
| 4,350,080 | 9/1982 | Page | 417/342 X |
| 4,546,607 | 10/1985 | Kime | 60/372 |

FOREIGN PATENT DOCUMENTS

| | | | |
|---|---|---|---|
| 1082566 | 6/1960 | Fed. Rep. of Germany | 417/342 |

*Primary Examiner*—Edward K. Look

*Attorney, Agent, or Firm*—Hopgood, Calimafde, Kalil, Blaustein & Judlowe

[57] ABSTRACT

The invention contemplates oil-well pumping apparatus (a) in which a traction cylinder is mounted at the well-head for direct reciprocating operation of the polish rod from which a pumping piston is suspended in a well casing, and (b) in which hydraulic-counterweight principles of copending application, Ser. No. 601,481, filed Apr. 18, 1984 are employed to reduce lift-capacity requirements which would otherwise be imposed on the prime mover. In one embodiment, wherein a single well is to be pumped, a pressurized hydraulic accumulator is connected to the traction cylinder via a power integrator which is so driven by the prime mover as to shuttle hydraulic fluid under pressure between the accumulator and the traction cylinder, to accomplish the traction cylinder action necessary to drive the polish rod and its load; in another embodiment, wherein two nearby wells are to be pumped, the hydraulic accumulator is replaced by the traction cylinder for the polish-rod assembly of the second well, and the pumping cycle of one well is in phase opposition to that of the other well, so that the minimum loads of the respective traction cylinders offset each other.

21 Claims, 6 Drawing Figures

OIL-WELL PUMPING SYSTEM OR THE LIKE

BACKGROUND OF THE INVENTION

The invention relates to hydraulic lift mechanism wherein lift is accomplished through a continuous cyclic succession of vertical reciprocation. And the invention will be particularly described in application to the kind of vertical reciprocation involved in the pumped recovery of oil from one or more well casings.

The conventional oil-well pumping mechanism involves substantial frame structure at the well head, mounting a large beam, counterweighted at one end, and from the other end of which a pumping piston with associated check valve is suspended via a polish rod to a pumping depth which may be as much as or more than a mile beneath the well head. The beam is driven in angular oscillation by one of a variety of continuously running prime movers, such as a diesel engine or an electric motor having crank and link connection to the counterweighted half of the beam. There have been situations in which the polish rod has been connected to the piston rod of a hydraulic cylinder, and in that event the continuously running prime mover drives a pump, connected to the cylinder by suitably controlled valving to develop the vertically reciprocating strokes needed for pumping.

The disadvantage of the purely mechanical structures is that they are bulky, cumbersome, and relatively expensive in regard to both initial investment and maintenance. The disadvantage of the indicated hydraulically operated system is that prime-mover power must be of sufficiently great capacity to provide lift for the polish rod and its piston, plus the pumped column of oil, throughout the lifting stroke of the pumping cycle. And if hydraulic actuation has been provided as the means of operating a reciprocating beam, then the above-expressed disadvantages of a mechanically driven beam apply.

BRIEF STATEMENT OF THE INVENTION

It is an object to provide improved means of developing vertically reciprocating displacement of a load.

A specific object is to provide improved hydraulic means for developing oil-well or the like pumping action.

Another specific object is to provide hydraulic means meeting the above objects and capable of operating more than one oil-well pump at a time.

A general object is to meet the above objects with structure characterized by relatively low initial and maintenance expense, requiring substantially reduced prime-mover power, and inherently less cumbersome than heretofore.

These objects and further features of the invention are realized in oil-well pumping apparatus (a) in which a traction cylinder is mounted at the well-head for direct reciprocating operation of the polish rod from which a pumping piston is suspended in a well casing, and (b) in which hydraulic-counterweight principles of my copending application, Ser. No. 601,481, filed Apr. 18, 1984 are employed to reduce lift-capacity requirements which would otherwise be imposed on the prime mover. In one embodiment, wherein a single well is to be pumped, a hydraulic accumulator is connected to the traction cylinder via a power integrator which is so driven by the prime mover as to shuttle hydraulic fluid under pressure between the accumulator and the traction cylinder, to accomplish the traction cylinder action necessary to drive the polish rod and its load; in this embodiment, the accumulator is pressurized to provide a substantially constant lift force which is substantially halfway between the maximum load of an oil-lifting stroke and the minimum load of a returning downstroke, and the power integrator is a hydraulic-displacement device which adds the increment of power needed for the pump-lift or upstroke, and absorbs power while controlling the pump-return or downstroke. In another embodiment, wherein two nearby wells are to be pumped, the hydraulic accumulator is replaced by the traction cylinder for the polish-rod assembly of the second well, and the pumping cycle of one well is in phase opposition to that of the other well, so that the minimum loads of the respective traction cylinders offset each other, whereby the power rating of the prime mover need only be sufficient to provide requisite shuttling displacement of hydraulic fluid, back and forth between the two traction cylinders.

A power integrator, as contemplated herein, is a rotary liquid displacement device having two spaced flow-connection ports and an interposed rotor with externally accessible shaft connection to the rotor, and the expression "rotary" as used herein in connection with such a device is to be understood as including various known rotary-pump structures, such as gear-pump and sliding-vane devices, as well as axially reciprocating and radially reciprocating configurations, wherein rotor-shaft rotation is related to hydraulic flow into one port and out the other port. In other words, such "rotary" devices provide for such hydraulic flow, and they provide for an external input/output torque response relation to hydraulic flow.

DETAILED DESCRIPTION

The invention will be illustratively described in connection with the accompanying drawings, in which.

Figure 1:
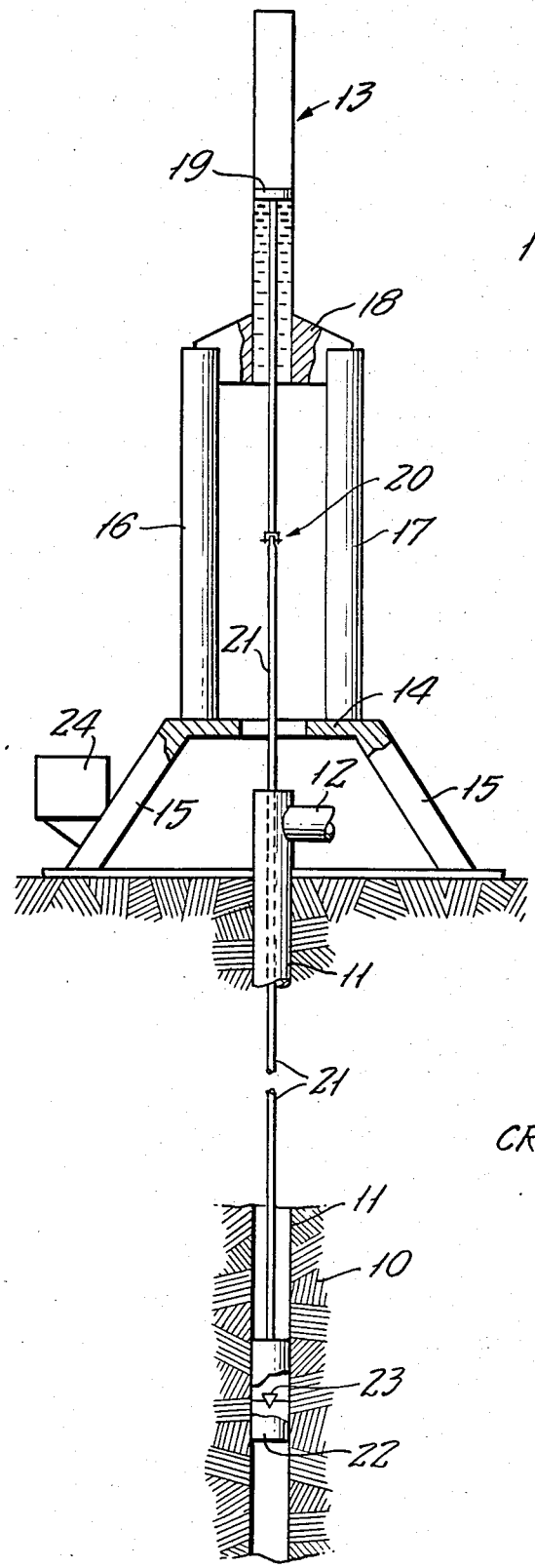
FIG. 1 is a simplified view in elevation to illustrate the larger structural components of oil-well pumping apparatus, in a single-well pumping situation.

Referring initially to FIG. 1, the invention is shown in application to the pumping of oil from a subsurface region 10, via a well casing 11 to a point 12 of delivery at the wellhead. Supporting structure for an upstanding traction cylinder 13 at the wellhead comprises a platform 14 with ground-stabilizing legs 15; and a pair of spaced upstanding cylinders 16–17 rise from platform 14 to a bridge connection 18 of their upper ends and to the tail end of traction cylinder 13. The piston 19 of cylinder 13 is rod-connected at 20 to an elongate polish rod 21, and a pumping piston 22 (with its check valve 23) is suspended in casing 11 at a sufficient depth to draw from a subterranena pool or reservoir of oil. The means for operating the piston 19 of cylinder 13 is relatively simple and of little bulk, being schematically shown in FIGS. 2 and 3, and contained in a housing 24 of relatively small volume.

Figure 2:
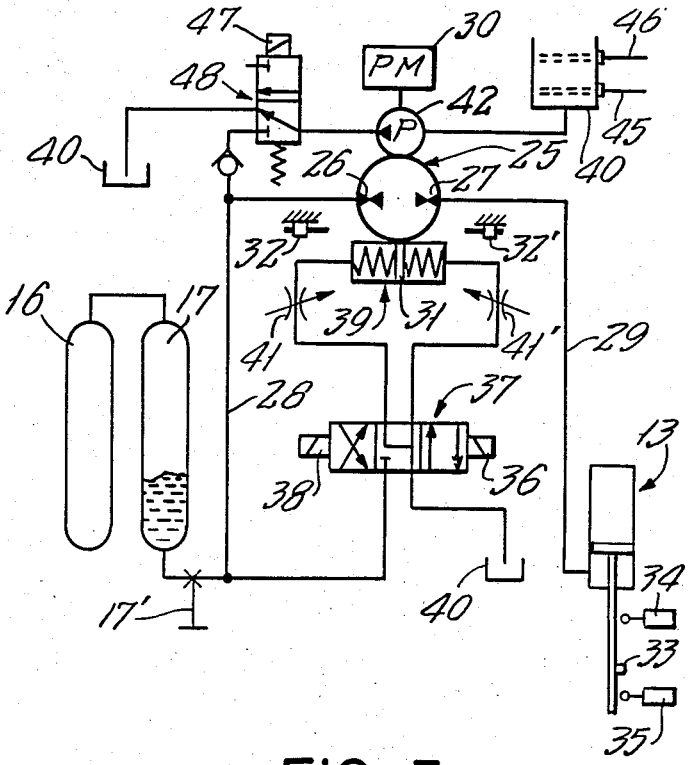
FIG. 2 is a schematic diagram of hydraulic control circuitry for the pumping apparatus of FIG. 1.

In the hydraulic circuit of FIG. 2, the upper ends of cylinders 16–17 are seen to be interconnected, and the lower end of cylinder 17 is connected for dispensing and reception of hydraulic fluid. Cylinders 16–17 cooperatively define a hydraulic accumulator wherein the volume available for pressurizing gas (e.g., commercial nitrogen) very much exceeds the volume of accommodated hydraulic fluid. A power integrator is symbolized at 25 and will be understood to include a rotor between two port connections 26–27; a line 28 connects port 26 with the lower end of accumulator cylinder 17, and a line 29 connects port 27 with the tail end of traction cylinder 13. The rotor of the power integrator is continuously driven in one direction by a prime mover 30, which may be an electric motor or a diesel or other engine.

The power integrator 25 is suitably a variable-displacement axial-piston pump, even though it will become clear that it only functions as a pump during the lifting stroke of traction cylinder 13. An axial-piston pump is well understood and therefore needs no present detailed description; in the present case of its use at 25, it will be understood to include a swash plate or the like and movable means (symbolized at 31) whereby the amplitude and phase of pump action may be varied continuously from a condition of maximum flow rate in the direction from port 26 to port 27, to a mid-position of zero flow, and then to a condition of maximum flow rate in the direction from port 27 to port 26. In FIG. 2, adjustable stops 32–32′ will be understood to provide selection of the limiting positions for movable means 31, whereby to determine maximum rates of hydraulic fluid displacement in the respective directions of flow between ports 26–27 and, hence, between accumulator cylinder 17 and traction cylinder 13.

The phase-adjusting movable element 31 of the power integrator is automatically shifted to establish flow reversal between ports 26–27 at the end of each of the up and down strokes of traction-cylinder operation. In the form shown, this is accomplished when a collar 33 (on the rod of piston 19) trips a fixedly mounted upper-limit switch 34 at or near a predetermined upper limit of rod reciprocation, and when collar 33 similarly trips a fixedly mounted lower-limit switch 35 at or near a predetermined lower limit of rod reciprocation. Switch 34 is operative to energize a first solenoid 36 of a three-position reversing valve 37, and switch 35 is similarly operative to energize a second solenoid 38 of valve 37. Actuation of switch 34 (and solenoid 36) shifts valve 37 so as to direct pressure fluid from line 28 to one end of a double-acting cylinder 39 for actuating the movable element 31 of the power integrator; at the same time, the other end of cylinder 39 is connected for discharge to a fluid reservoir or sump 40. The rate of this action is cushioned by an adjustable orifice 41 (41′) in each of the respective connections to cylinder 39. When both solenoids 36–38 are de-energized, preloading springs will be understood to bring valve 37 to its center position, thereby relieving hydraulic pressure on both ends of the double-acting cylinder 39.

Figure 3:
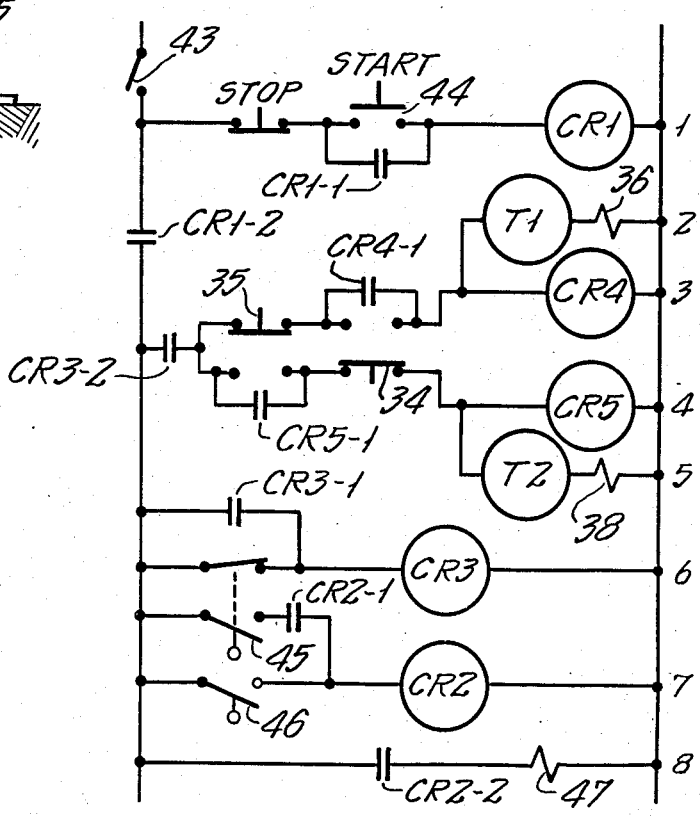
FIG. 3 is an electrical ladder diagram to show electrical control connections for operation of the hydraulic circuitry of FIG. 2.

Operation of the hydraulic circuit of FIG. 2 will be explained with further reference to the electrical ladder diagram of FIG. 3. In this connection, it should be remembered that primary operating pressure for the hydraulic system is available from the accumulator 16–17, and that when the system is shut down, a shut-off valve 17′ at the accumulator assures against loss of operating pressure.

Upon closing a key-operated line switch 43, power is available to start the prime mover 30 and an associated hydraulic pump 42, via start contacts 44, thereby energizing the coil of a first control relay CR1 having first contacts (CR1-1) to latch-in and hold relay CR1 at level 1 of the ladder diagram; at the same time, second contacts (CR1-2) of this relay extend line voltage availability to the remaining seven levels of the ladder. If this starting operation is undertaken several days after prior operation, the level of hydraulic operating fluid will be high in the tank reservoir 40 into which the system-operating fluid can drain; in this circumstance, both lower and upper float switches 45–46 in reservoir 40 will be immersed, to close their respective contacts at level 7 of the ladder, thereby energizing a second control relay CR2 (via the closed contacts of upper-level switch 46) and holding relay CR2 via its latching contacts CR2-1 and the closed contacts of lower-level switch 45; at the same time, second contacts (CR2-2) of control relay CR2 close to energize the solenoid 47 of a charging valve 48, which shifts (out of its normal condition of returning fluid to sump 40) into its actuated condition of directing hydraulic fluid, pumped from reservoir 40, and via a check valve 49 to pressure line 28 and the accumulator 16–17. As thus far described, the operation will be seen merely as one of fluid replenishment from sump tank 40 to the operating line 28, it being understood that when tank 40 is sufficiently depleted to open the lower float switch contacts 45, the control relay CR2 is de-energized, to direct any pumped hydraulic fluid back to the sump tank 40. The replenishment function will not resume until the sump tank reaches the point of closing the contacts of the upper float switch 46.

Full replenishment of the hydraulic fluid into the operational circuit of the accumulator 16–17, the power integrator 25 and the traction cylinder 13 is certified when the lower float switch 45 drops out control relay CR2 and its normally closed back contacts complete a circuit (at level 6) to the coil of a third control relay CR3, whereupon latching contacts CR3-1 close to hold-in the relay CR3; this operation of relay CR3 also closes its second contacts CR3-2, to enable automatic control of oil-well pumping reciprocation through alternating excitation of fourth and fifth control relays CR4 and CR5 (levels 3 and 4). The latched condition of relay CR3 will continue indefinitely as long as the prime mover 30 is running, i.e., until line switch 43 is opened (or the stop button at level 1 is depressed) to stop all operations.

Assuming that integrator 25 was in the condition in which it displaces hydraulic fluid in the direction from port 26 to port 27, the traction cylinder will be actuated in its up-stroke, the end of which is signaled by trip (33) actuation of the upper limit switch 34. As seen in FIG. 3, switch 34 is actuable to open a normally closed contact relation (at level 4) to close its normally open contacts (at level 3), whereupon line voltage is completed to control relay CR4, a condition that is retained by latching contacts CR4-1 of relay CR4. Completion of the circuit of level 3 also completes a parallel circuit at level 2, thus initiating a timer $T_1$ and eventual actuation of the reversing solenoid 36 of valve 37; at the same time, the opening of the normally closed contacts of upper limit switch 34 is effective to interrupt the level-4 circuit which had been latched by contacts CR5-1 of control relay CR5, thus terminating excitation of the solenoid 38 of valve 37, and allowing valve 37 to return to its normal mid-position wherein centering springs in the double-acting cylinder 39 can be operative at a controlled slow pace, and wherein hydraulic fluid in cylinder 39 can be relieved to sump 40 via one of the restrictive orifices 41 (41'). The delay timing of timer $T_2$ will be understood to be such as to permit deceleration of the up-stroke action in traction cylinder 13, allowing the indicated venting of cylinder 39 and avoiding mechanical shock to the pumping system.

Only upon timing out the predetermined interval of timer $T_1$ will the reversing solenoid 36 become energized, calling for double-acting cylinder 39 to shift the phase of the power integrator, for controlled withdrawal of hydraulic fluid from cylinder 13 while restoring the same to the accumulator cylinder 17. The polish rod 21 will proceed through the downstroke of the well-pumping cycle, being terminated when trip 33 actuates lower limit switch 35, thus interrupting the level 2 and 3 circuits and re-establishing the level 4 and 5 circuits, which it will be recalled are held by the latching contacts CR5-1 of control relay CR5. A deceleration phase again proceeds, wherein valve 37 returns to its mid-position (being no longer actuated by solenoid 36) so that double-acting cylinder 39 can gradually bleed its actuating fluid while the power-integrator phase is again shifted; the timing for this deceleration phase is governed by the preset interval of a second timer $T_2$, which will be understood to delay excitation of solenoid 38 until all or substantially all downstroke momentum has been dissipated. Excitation of solenoid 38 initiates the up-stroke phase with the same delay as phase is gradually shifted in the power integrator, the delay being again as controlled by bleed action of the applicable one of the orifices 41 (41').

Figure 4:
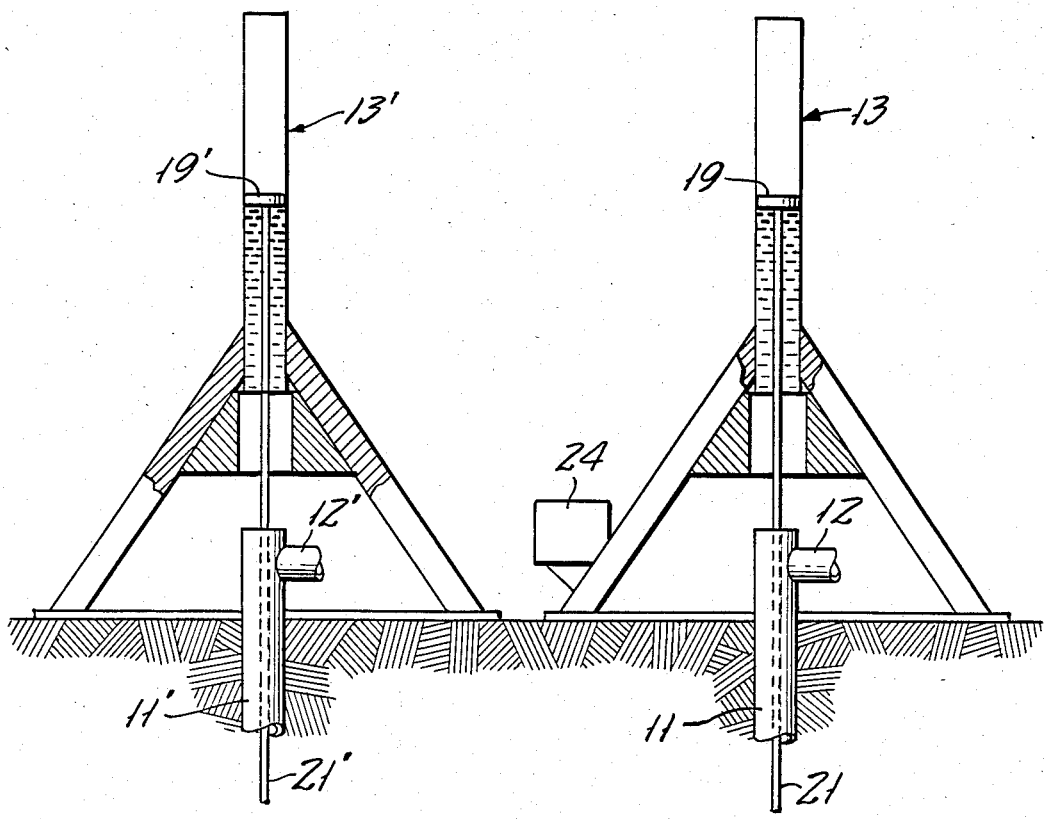
FIG. 4 is a diagram similar to FIG. 1, for a two-well pumping system of the invention.
Figure 5:
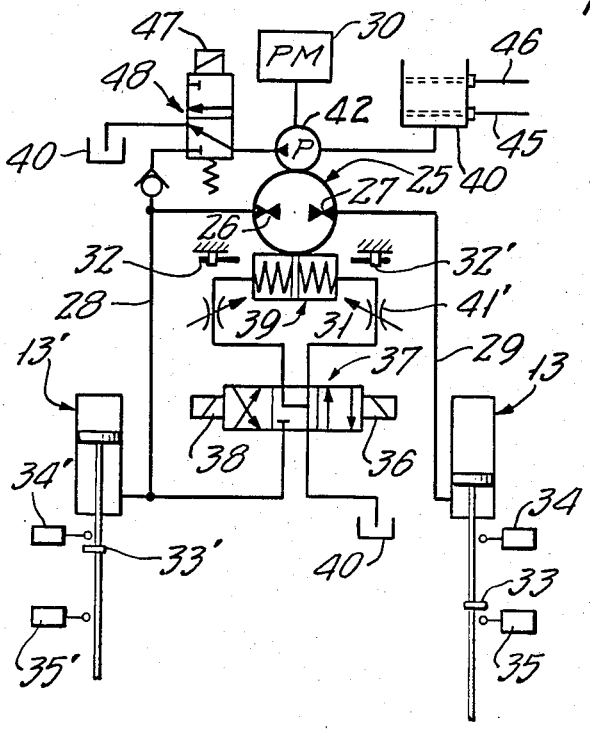
FIGS. 5 and 6 respectively correspond to FIGS. 2 and 3, for the two-well system of FIG. 4.
Figure 6:
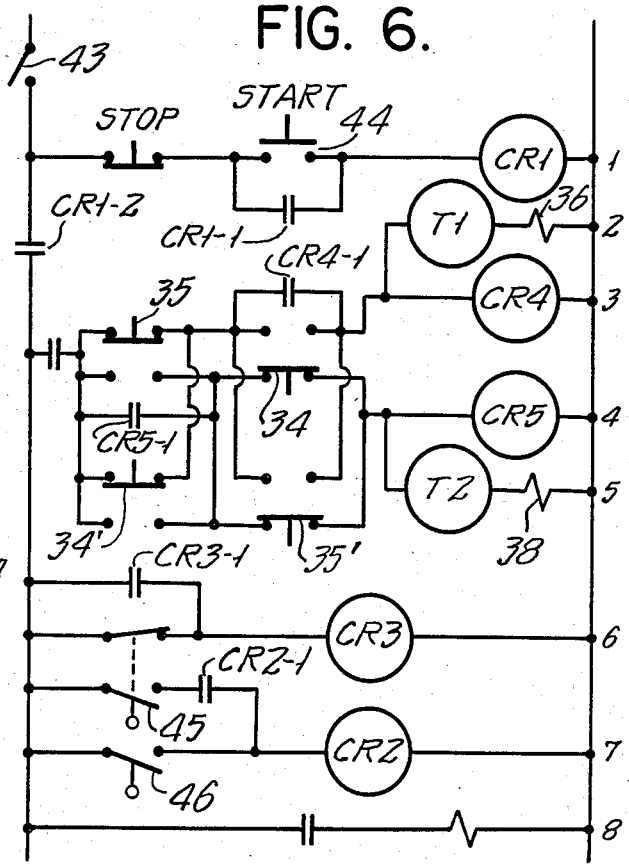

In FIGS. 4, 5 and 6, the invention is shown in application to concurrent operation of two nearby wells, pumping in phase interlace, namely, an upstroke of the polish rod 21 in one well during the downstroke of the polish rod 21' of the other well, all under control of the single hydraulic circuit of FIG. 5 and the associated electrical circuit of FIG. 6. The essential difference between the system of FIGS. 4 to 6 and that of FIGS. 1 to 3 is that traction cylinder 13' of the second well replaces the hydraulic accumulator 16–17, and the lower and upper limit-switch system 33'–34'–35' of the second well involves normally open and normally closed contacts which are in parallel with those described for switches 35–34, whereby whichever one of the trips 33 (33') first reaches its stroke limit, e.g., switch 34 compared to switch 35', and switch 35 compared to switch 34', will determine the drop out of the applicable one of solenoids 36–38 and a corresponding timing-out of deceleration of both the up-stroke of one polish rod 21 (21') and the downstroke of the other polish rod 21' (21), all as part of the smooth reversing operation which has already been described. Because of the close similarity of the operative components for the FIGS. 4 to 6 system and for the FIGS. 1 to 3 system, the same reference numbers are used throughout, with primes as necessary to differentiate in applicability to the second well.

The described single-well and dual-well pumping systems will efficiently serve wells of a great range of depth, it being understood that the charge pressure, and the traction cylinder diameter and length are tailored to the requirements of lifting weight, stroke-repetition rate and stroke length. For example, for a first category wherein maximum lift capacity is 15,000 pounds, the stroke permitted by length of the traction cylinder may be up to 48 inches, and at a rate of 10 strokes per minute, wherein end-stop and stroke-reversal functions may require as much as 2 seconds at each stroke reversal, with acceleration and deceleration as fast as 2 ft/sec$^2$. In a second category wherein lift capacity is 30,000 pounds, with a stroke as large as 100 inches, the same stroke-repetition rate, stroke-reversal and acceleration/deceleration figures apply. And they also apply for a still heavier-duty system of 50,000-pound capacity and up to 180-inch stroke. Installed prime-mover power of course will be understood to be as appropriate for the various pump categories but it will in general be about one half of what is usual in conventional oil-pumping equipment.

While the invention has been described in detail for preferred embodiments, it will be understood that modifications may be made without departing from the scope of the invention. For example, the reference to a prime mover operating in a single drive direction, with integrator flow rate and direction determined by a double-acting hydraulic cylinder, and with mechanically smooth stroke reversal through controlled orifice bleeding of control fluid to and from the respective ends of a double-acting hydraulic cylinder, will be understood to state my present preference, in that a reversible prime mover, or a uni-directional prime mover with a suitably protected reversing-gear transmission may also be devised for drive connection to the rotor of integrator 25. Reversible-motor drives and other forms of power integrator are shown and described in my said copending application, Ser. No. 601,481 but, as indicated, they are not my preference in the present oil-well pumping application.

What is claimed is:

1. Reciprocating mechanism comprising a hydraulic cylinder and a piston having a reciprocable stroke between head and tail ends of said cylinder, said piston including a rod extending through said tail end and adapted for connection to a load which biases said piston in the direction to one of said ends of said cylinder, said cylinder having a hydraulic-fluid port communicating with the cylinder end via which hydraulic pressure is operative in the direction opposed to said load bias; a hydraulic accumulator, a power integrator having first and second ports respectively connected to said cylinder port and to said accumulator, and a volume of hydraulic fluid self-contained within the included volume of said cylinder and integrator and accumulator to the extent at least sufficient to enable operation of said piston for more than the span of said stroke, said accumulator having a volume substantially in excess of said hydraulic-fluid volume and said accumulator being under gas pressure at a level at least sufficient to balance said load bias, said integrator further including a rotor having a torsionally responsive relation to port-to-port flow through the integrator; prime-mover means for continuously driving said rotor in one direction of hydraulic flow between said cylinder and said accumulator, first means responsive to piston displacement to one end of said stroke for reversing the direction of flow between said cylinder and said accumulator, second means responsive to piston displacement to the other end of said stroke, for again reversing the hydraulic flow between said cylinder and said piston for recycled reciprocation of said mechanism, a sump for accumulation of drained hydraulic fluid, and means including a sump pump with upper and lower sump-level switches for intermittently returning hydraulic fluid to said accumulator, thereby maintaining said self-contained volume as a constant, within limits of relatively small variation attributable to the respective operative sump levels of said switches.

2. Reciprocating mechanism comprising a hydraulic cylinder and a piston having a reciprocable stroke between head and tail ends of said cylinder, said piston including a rod extending through said tail end and adapted for connection to a load which biases said piston in the direction to one of said ends of said cylinder, said cylinder having a hydraulic-fluid port communicating with the cylinder end via which hydraulic pressure is operative in the direction opposed to said load bias; a hydraulic accumulator, a power integrator having first and second ports respectively connected to said cylinder port and to said accumulator, and a volume of hydraulic fluid self-contained within the included volume of said cylinder and integrator and accumulator to the extent at least sufficient to enable operation of said piston for more than the span of said stroke, said accumulator having a volume substantially in excess of said hydraulic-fluid volume and said accumulator being under gas pressure at a level at least sufficient to balance said load bias, said integrator further including a rotor having a torsionally responsive relation to port-to-port flow through the integrator; prime-mover means for continuously driving said rotor, first means responsive to piston displacement to one end of said stroke for reversing the direction of prime-mover drive of said rotatable means, second means responsive to piston displacement to the other end of said stroke for again reversing the direction of prime-mover drive of said rotatable means for recycled reciprocation of said mechanism, a sump for accumulation of drained hydraulic fluid, and means including a sump pump with upper and lower sump-level switches for intermittently returning hydraulic fluid to said accumulator, thereby maintaining said self-contained volume as a constant, within limits of relatively small variation attributable to the respective operating sump levels of said switches.

3. Reciprocating mechanism for vertically actuating the polish rod of a pump piston suspended in the casing of an oil well or the like, said mechanism comprising a hydraulic cylinder and an actuator piston having a reciprocable stroke between head and tail ends of said cylinder, said actuating piston including a rod extending through said tail end and adapted for lifting connection to the polish rod of the pump piston, whereby the polish rod and associated pump piston may bias said actuating piston in the direction to one of said cylinder ends, said cylinder having a hydraulic-fluid port communicating with the cylinder end via which hydraulic pressure in the cylinder is operative in the direction opposed to polish-rod bias; a hydraulic accumulator, a power integrator having first and second ports respectively connected to said cylinder port and to said accumulator, and a volume of hydraulic fluid self-contained within the included volume of said said cylinder and integrator and accumulator to the extent at least sufficient to enable operation of said actuator piston for more than the span of said stroke, said accumulator having a volume substantially in excess of said hydraulic-fluid volume and said accumulator being under gas pressure at a level at least sufficient to balance the polish-rod bias, said integrator further including a rotor having a torsionally responsive relation to port-to-port flow through the integrator; prime-mover means for continuously driving said rotor in one direction of hydraulic flow between said cylinder and said accumulator, first means responsive to actuating piston displacement to one end of said stroke for reversing the direction of flow between said cylinder and said accumulator, second means responsive to actuating piston displacement to the other end of said stroke for again reversing the hydraulic flow between said cylinder and said actuating piston for recycled reciprocation of said mechanism, a sump for accumulation of drained hydraulic fluid, and means including a sump pump with upper and lower sump-level switches for intermittently returning hydraulic fluid to said accumulator, thereby maintaining said self-contained volume as a constant, within limits of relatively small variation attributable to the respective operative sump levels of said switches.

4. Reciprocating mechanism according to claim 3, in which said power integrator is an axial-piston device with a swash plate actuable to determine the magnitude and the direction of said port-to-port flow, and in which said first and said second means are connected for reversible positioning control of swash-plate actuation.

5. Reciprocating mechanism according to claim 4, in which said power integrator includes selectively adjustable limit stops for swash-plate actuation.

6. Reciprocating mechanism according to claim 4, in which the connection of said first and second means for positioning control includes a double-acting hydraulic cylinder having a control port at each end, a fluid-pressure supply line with a flow reversing valve having separate port connections to the respective control ports of said double-acting cylinder, and a restrictive orifice in each of said port connections.

7. Reciprocating mechanism according to claim 6, in which said restrictive orifices are selectively adjustable.

8. Reciprocating mechanism according to claim 3, in which said cylinder is a traction cylinder and the hydraulic-fluid port thereof is at the tail end.

9. Reciprocating mechanism according to claim 3, in which for a given speed of polish-rod upstroke in the casing there is a first or upper requirement of lifting force, and in which for a given speed of polish-rod downstroke in the casing there is a second or lower requirement of lifting force, the gas pressure in said accumulator being at a level to provide a lifting force via the actuator piston equal to a value intermediate said upper and lower requirements.

10. Reciprocating mechanism according to claim 3, in which the volume of said accumulator is at least ten times said volume of hydraulic fluid.

11. Reciprocating mechanism according to claim 3, in which the volume of said accumulator is in the order of twenty times said volume of hydraulic fluid.

12. Reciprocating mechanism according to claim 3, in which said accumulator comprises two elongate closed-end accumulator cylinders fixedly mounted in upstanding closely spaced array to the extent of straddling the oil-well casing, said accumulator cylinders being of length substantially matching the reciprocable stroke, and in which said hydraulic cylinder is a traction cylinder bridge-mounted to the upper ends of said accumulator cylinders with the actuating-piston rod reciprocable between said accumulator cylinders, a pressurized-gas connection line between the upper ends of said accumulator cylinders, the power-integrator connection to said accumulator being to the lower end of one of said accumulators.

13. Oil-well derrick structure according to claim 3, in which said accumulator cylinders are two of a larger plurality of angular spacing about the axis of said traction cylinder, all of said plurality being interconnected at their upper ends, and the lower end of one of said plurality being connected to said power integrator.

14. Reciprocating mechanism according to claim 3, in which said power integrator is operative to control a first rate of hydraulic flow from said accumulator to said hydraulic cylinder and a second and different rate of hydraulic flow from said hydraulic cylinder to said accumulator.

15. Oil-well derrick apparatus for reciprocating full-stroke actuation of the polish rod of a subsurface pumping piston in each of two nearby oil-well casings, said apparatus comprising a traction cylinder with its tail end mounted vertically above and in alignment with each of said casings, said traction cylinders each containing a piston rod-connected through the associated tail end to the associated polish rod, said cylinders being sufficiently elongate to accommodate piston displacement to at least the extent of said reciprocable stroke, a hydraulic connection including a power integrator between the respective tail ends of said traction cylinders, said power integrator including two ports having an interposed rotor having a torsionally responsive relation to hydraulic port-to-port flow therethrough, a supply of hydraulic fluid self-contained by and between said power integrator and the tail-side volume beneath the pistons of both cylinders when one piston is at the top of its stroke and the other piston is at the bottom of its stroke, a prime mover for driving said rotor, reversing means operative at the upper and lower limits of the stroke of at least one of said pistons for cyclically reversing the flow of hydraulic fluid between said cylinders, a sump for accumulation of drained hydraulic fluid, and means including a sump pump with upper and lower sump-level switches for intermittently returning hydraulic fluid to one of said ports, thereby maintaining the self-contained hydraulic-fluid supply at a substantially constant value, within limits of relatively small variation attributable to the respective operative sump levels of said switches.

16. Oil-well derrick apparatus according to claim 15, in which said reversing means includes separate means tracking upper and lower limits of the stroke of each of said pistons, said reversing means being connected (a) to initiate a reversal of said hydraulic flow upon first detection of a stroke limit as between the upstroke limit of one piston and the downstroke limit of the other piston and (b) to initiate the subsequent reversal of said hydraulic flow upon first detection of a stroke limit as between the downstroke limit of said one piston and the upstroke limit of the other piston.

17. Oil-well derrick apparatus according to claim 16, in which said power integrator includes selectively adjustable limit stops for swash-plate actuation.

18. Oil-well derrick apparatus according to claim 16, in which the connection of said first and second means for positioning control includes a double-acting hydraulic cylinder having a control port at each end, a fluid-pressure supply line with a flow reversing valve having separate port connections to the respective control ports of said double-acting cylinder, and a restrictive orifice in each of said port connections.

19. Oil-well derrick apparatus according to claim 18, in which said restrictive orifices are selectively adjustable.

20. Oil-well derrick apparatus according to claim 15, in which said power integrator is an axial-piston device with a swash plate actuable to determine the magnitude and the direction of said port-to-port flow, and in which said first and said second means are connected for reversible positioning control of swash-plate actuation.

21. In an oil-well or the like pumping system wherein reciprocating mechanism for the polish rod of a pump piston comprises a hydraulic cylinder and actuator piston adapted to impart a reciprocating stroke to the polish rod, wherein a reversible variable-flow pump connects a hydraulic accumulator to the hydraulic cylinder, wherein a sump collects system-drained hydraulic fluid, and wherein a sump pump is connected to draw hydraulic fluid from the sump to replenish the accumulator, the improvement (a) in which the volume of hydraulic fluid self-contained within the included volume of the cylinder and reversible pump and accumulator is to an extent at least sufficient to enable operation of said actuator piston for more than the span of said stroke, (b) in which the accumulator has a gas-charged volume that is substantially in excess of said hydraulic-fluid volume, whereby gas pressure in the accumulator will remain essentially constant throughout reciprocating strokes of said actuator piston, and (c) in which upper and lower sump-level switches are connected to control return of sump-pumped hydraulic fluid to the accumulator, whereby within the sump levels of switch response the excess of said gas-charged volume may remain substantial, thereby assuring substantially constant accumulator pressure during cyclic reciprocation of said mechanism.

* * * * *